US006311862B1

(12) United States Patent
Barnes

(10) Patent No.: US 6,311,862 B1
(45) Date of Patent: Nov. 6, 2001

(54) PAINT CAN THAT DOES NOT DRIP PAINT

(76) Inventor: Charles Barnes, P.O. Box 75, St. Charles, MO (US) 63303

( * ) Notice: Subject to any disclaimer, the term of this patent is extended or adjusted under 35 U.S.C. 154(b) by 0 days.

(21) Appl. No.: 09/588,781

(22) Filed: Jun. 5, 2000

(51) Int. Cl.[7] ..... B65D 43/10
(52) U.S. Cl. ..... 220/698
(58) Field of Search ..... 220/698

(56) References Cited

U.S. PATENT DOCUMENTS 1,696,240 * 12/1928 Kircher, Jr. ..... 220/698
2,084,084 * 6/1937 Greer ..... 220/698
2,207,210 * 7/1940 von Knauf ..... 220/698
4,312,459 * 1/1982 Leach ..... 220/698
4,446,986 * 5/1984 Bowen et al. ..... 220/698
5,160,067 * 11/1992 Luber .

* cited by examiner

*Primary Examiner*—Joseph M. Moy
(74) *Attorney, Agent, or Firm*—Henry W. Cummings

(57) ABSTRACT

In accordance with the present invention a paint can having a bottom and an integrally formed side wall portion, having a top portion having an inwardly extending rim portion containing a plurality of spaced openings therein of sufficient size to return any paint which flows into the rim into the paint can. The openings are preferably placed on only one side of the rim so that the other side of the rim can be used for pouring without paint being spilled through the openings. The openings may be circular, square, rectangular, polygon eliptical, or any other convenient shape so long as they have sufficient size to avoid surface tension causing the paint to fill the opening and prevent flow back into the can.

13 Claims, 3 Drawing Sheets

PAINT CAN THAT DOES NOT DRIP PAINT

I FIELD OF THE INVENTION

This invention relates to paint cans that do not drip.

II BACKGROUND OF THE INVENTION

U.S. Pat. No. 1,984,170 discloses a paint can having a crown in its top having a cross bar to remove excess paint from a paint brush and return excess paint into the can.

U.S. Pat. No. 2,418,502 discloses a paint can having a crown in its top having a removable tray which projects from the side of the can to remove excess paint from a paint brush and return excess paint into the can.

U.S. Pat. No. 2,591,482 discloses a paint can having a crown in its top having a removable splash protector which projects from the side of the can to remove excess paint from a paint brush and return excess paint into the can.

U.S. Pat. No. 3,133,668 discloses a paint can having a crown in its top having a removable shelf 14 to remove excess paint from a paint brush and return excess paint through opening 50 into the can.

U.S. Pat. No. 3,133,668 discloses a paint can having a crown in its top having a removable extension 10 which engages the can wall 2 with a depending skirt 8 and an inwardly extending shelf 6. Extension 10 removes excess paint from a paint brush and includes openings 11 which return excess paint into the can.

However none of the prior art provides openings in the rim of the paint can to return excess paint into the can.

III SUMMARY OF THE INVENTION

The object of the present invention is to provide a paint can having an upper rim which may be used to remove paint from the paint brush, and allowing the paint in the upper rim to return to the body of the paint can.

In accordance with the present invention a paint can having a bottom and an integrally formed side wall portion, having a top portion having an inwardly extending rim portion containing a plurality of spaced openings therein of sufficient size to return any paint which flows into the rim into the paint can. The openings are preferably placed on only one side of the rim so that the other side of the rim can be used for pouring without paint being spilled through the openings. The openings may be circular, square, rectangular, polygon or any other convenient shape so long as they have sufficient size to avoid surface tension causing the paint to fill the opening and prevent flow back into the can.

IV THE DRAWINGS

V DESCRIPTION OF PREFERRED EMBODIMENTS

Figure 1:
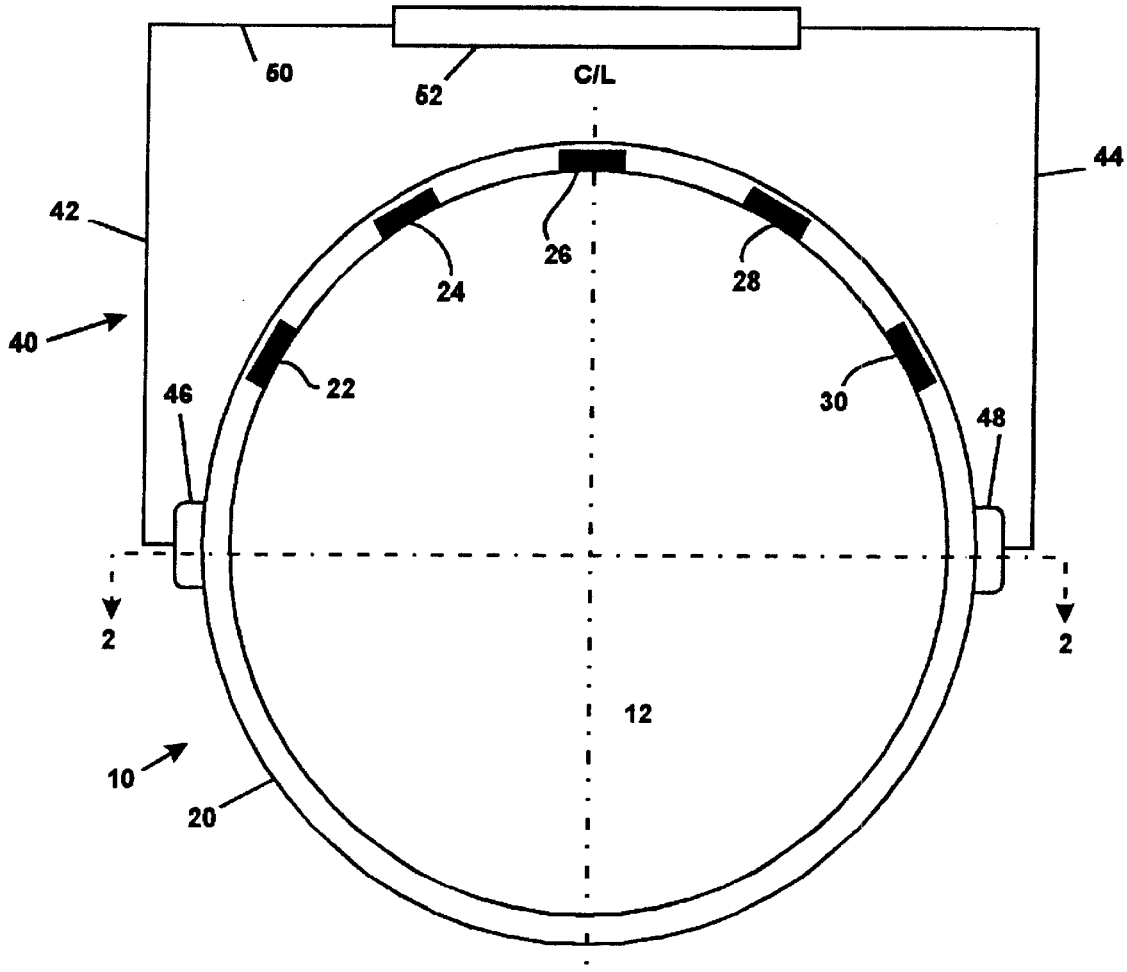
FIG. 1 is a plan view of one embodiment of the present invention.
Figure 2:
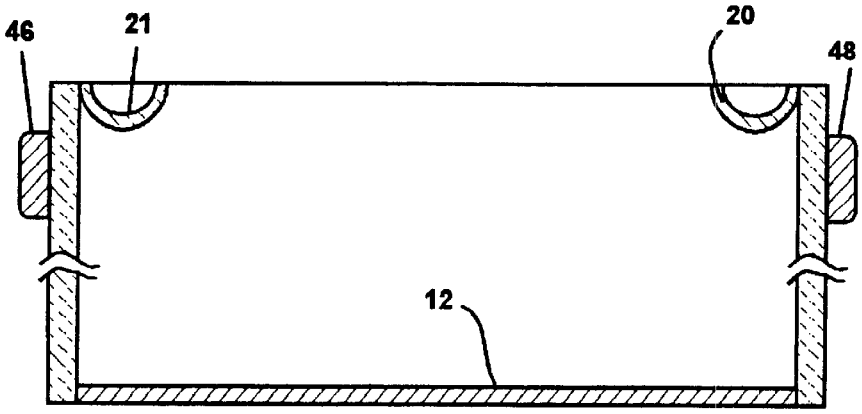
FIG. 2 is a sectional elevation view looking in the direction of the arrows along the line 2—2 in FIG. 1.

In accordance with the present invention a paint can 10 having a bottom 12 and an integrally formed side wall portion 14, conviently, though no necessarily, circular, includes a top portion 16 having an inwardly extending rim portion 20 of arcuate cross section 21 and containing a plurality of spaced openings therein 22, 24, 26, 28 30 of sufficient size to return any paint which flows into the rim into the paint can. The openings are preferably placed on only one side of the rim on either side of center line C/L, so that the other side of the rim can be used for pouring without paint being spilled through the openings. The arcuate contour 21 allows a paint can lid (not shown) having a downwardly extening projection to fit snugly within the arccuate contour 21 after the paint has been poured into the paint can and the lid applied to keep the paint from the atmosphere until it is time to open the can for painting.

Figure 3:
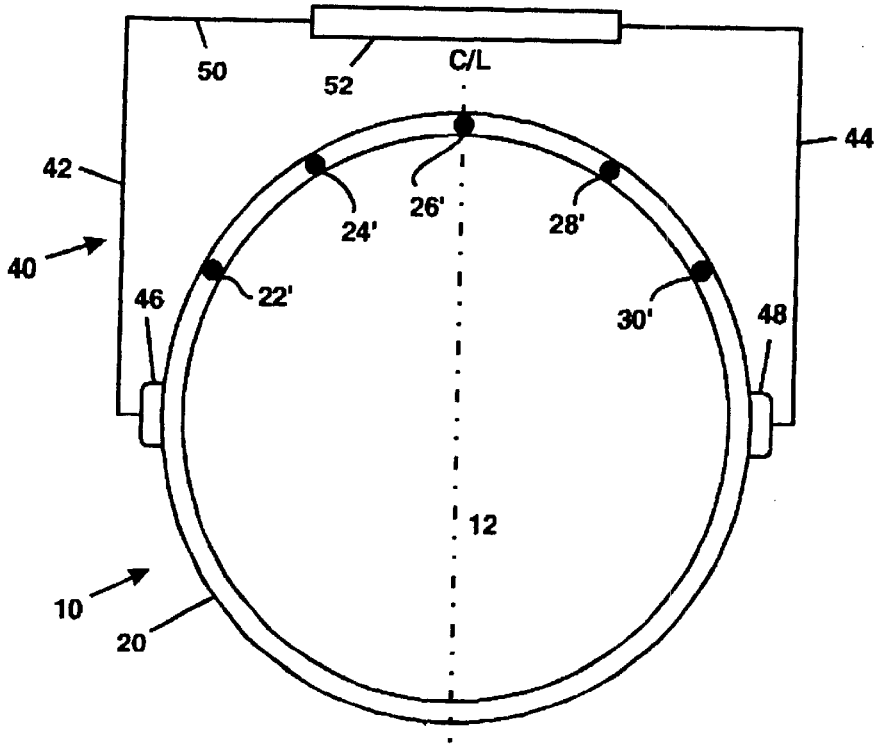
FIG. 3 is a plan view of another embodiment of the present invention.
Figure 4:
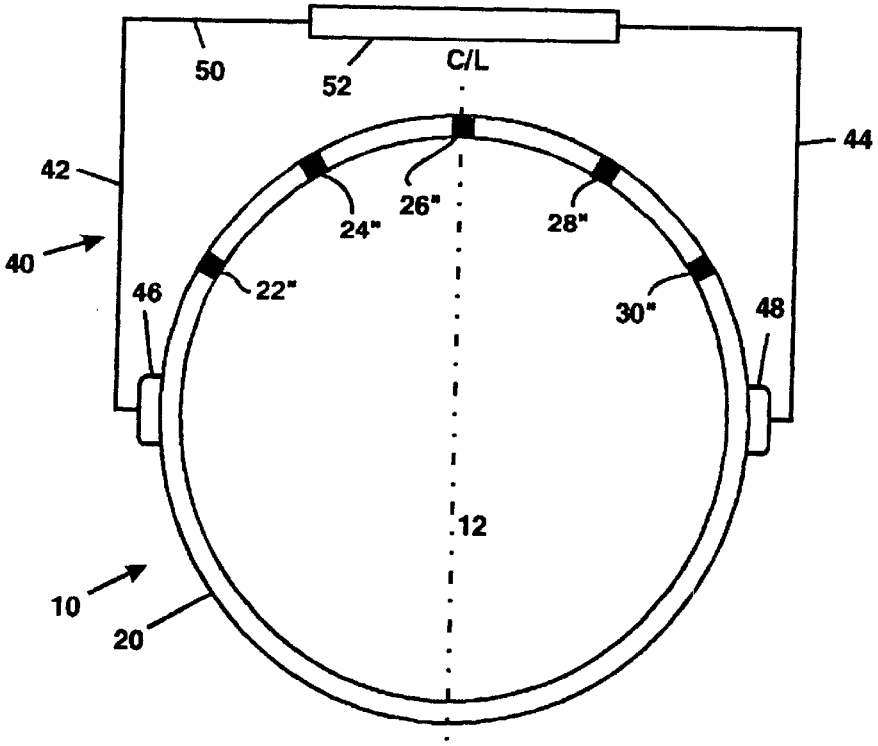
FIG. 4 is a plan view of another embodiment of the present invention.
Figure 5:
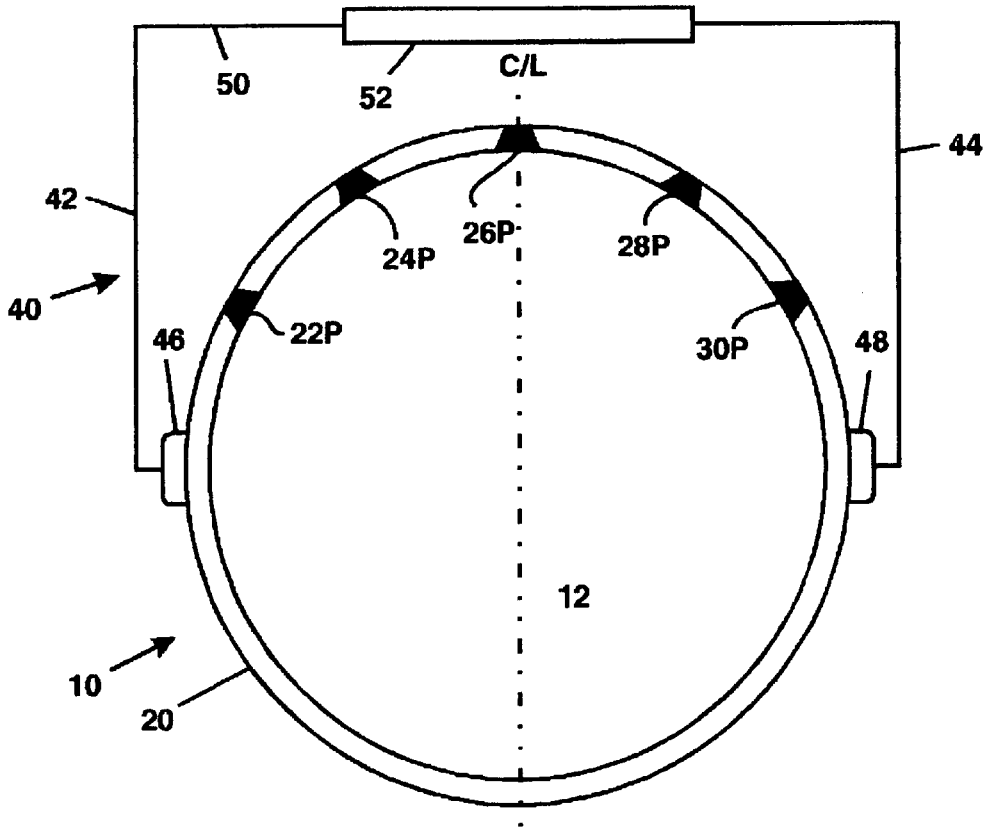
FIG. 5 is a plan view of another embodiment of the present invention.

The openings may be rectangular as in FIG. 1 circular as in FIG. 3, 22', 24', 26', and 30'; square, as in FIG. 4, 22", 24", 26", 28", and 30"; polygon, as in FIG. 5, 22P, 24P, 28P and 30P; eliptical, or any other convenient shape so long as they have sufficient size to avoid surface tension causing the paint to fill the opening and prevent flow back into the can.

The can conviently includes a handle 40 having arms 42 and 44 which are connected to lugs 46 and 48 on either side of the can, and a transverse arm 50 having a grip 52 attached thereto for example with an adhesive or with mechanical fasteners.

The openings are preferably ½" to 1½" apart.

In one embodiment the openings are ½" to 1½" long, and 1/16" to 3/8" wide.

In another embodiment the openings are 1/16" to 3/8" in diameter.

In another embodiment the openings are 1/16" to 3/8" square.

The openings can be formed by drilling or stamping them out during formation of the paint can.

What is claimed is:

1. A paint can comprising:

a paint can bottom;

an integrally formed side wall portion extending upwardly from said bottom;

said paint can having a top portion extending radially inwardly from said side wall portion including an inwardly extending groove which extends 360 degrees within said top portion;

said groove extending within a first side and a second side of said top portion;

said groove containing a plurality of spaced openings in said first side of about 180 degrees only of sufficient size to return any paint which flows into said groove into said paint can, with the remaining 180 degrees on said second side being free from said openings, whereby said second side can be used for pouring with little or no paint being spilled during pouring.

2. A paint can according to claim 1 wherein said openings are selected from circular, square, rectangular, and polygon shapes.

3. A paint can according to claim 2 wherein said paint can groove portion is of arcuate cross section.

4. A paint can according to claim 3 wherein said openings are ½" to 1½" apart.

5. A paint can according to claim 3 wherein said openings are rectangular.

6. A paint can according to claim 5 wherein said openings are ½" to 1½" long, and 1/16" to 3/8" wide.

7. A paint can according to claim 3 wherein said openings are generally circular.

8. A paint can according to claim 7 wherein said openings openings are 1/16" to 3/8" in diameter.

9. A paint can according to claim 3 wherein said openings are generally square.

10. A paint can according to claim 9 wherein said openings are 1/16" to 3/8" square.

11. A paint can according to claim 3 wherein said openings are polygon in shape.

12. A paint can according to claim 3 wherein said openings are formed by drilling during formation of said paint can.

13. A paint can according to claim 3 wherein said openings are formed by stamping them out during formation of said paint can.

* * * * *